US008955234B2

(12) United States Patent
Williams

(10) Patent No.: US 8,955,234 B2
(45) Date of Patent: Feb. 17, 2015

(54) TRANSPORTABLE FORCED AIR DRYER

(71) Applicant: Gary Williams, Langley (CA)

(72) Inventor: Gary Williams, Langley (CA)

(73) Assignee: Williams Boot & Glove Dryers Inc., Langley, BC (CA)

( * ) Notice: Subject to any disclaimer, the term of this patent is extended or adjusted under 35 U.S.C. 154(b) by 156 days.

(21) Appl. No.: 13/894,534

(22) Filed: May 15, 2013

(65) Prior Publication Data

US 2014/0338212 A1 Nov. 20, 2014

(51) Int. Cl.

| | |
|---|---|
| ***F26B 23/04*** | (2006.01) |
| ***A47L 23/20*** | (2006.01) |
| ***D06F 59/04*** | (2006.01) |
| ***F26B 9/00*** | (2006.01) |
| ***F26B 21/00*** | (2006.01) |

(52) U.S. Cl.

CPC ..... *A47L 23/205* (2013.01); *D06F 59/04* (2013.01); *F26B 9/003* (2013.01); *F26B 21/001* (2013.01); *F26B 21/004* (2013.01); *F26B 23/04* (2013.01)

USPC ..... 34/105; 34/239; 211/85.7; D32/58; 219/386; 68/5 D

(58) Field of Classification Search

USPC ..... 34/90, 102, 103, 104, 105, 201, 210, 34/232, 239; 211/85.3, 85.7, 189, 205; D32/58, 59; 219/386, 400; 68/5 D, 20

See application file for complete search history.

(56) References Cited

U.S. PATENT DOCUMENTS

| | | | | | |
|---|---|---|---|---|---|
| 3,513,564 | A * | 5/1970 | Gramprie | 34/104 |
| 4,677,714 | A * | 7/1987 | Wright | 411/554 |
| 5,222,308 | A * | 6/1993 | Barker et al. | 34/104 |
| 5,412,928 | A * | 5/1995 | Reithel | 34/104 |
| 5,893,216 | A * | 4/1999 | Smith et al. | 34/103 |
| D412,231 | S * | 7/1999 | Williams et al. | D32/58 |
| 6,005,227 | A * | 12/1999 | Pappas | 219/400 |
| 6,766,594 | B2 * | 7/2004 | DuRapau | 34/437 |
| 6,796,053 | B2 * | 9/2004 | Lurie | 34/104 |
| 6,880,711 | B2 * | 4/2005 | Collier | 211/85.7 |
| 7,299,614 | B2 * | 11/2007 | Sanders | 56/400.01 |
| 2004/0068888 | A1 * | 4/2004 | Lurie | 34/90 |

(Continued)

FOREIGN PATENT DOCUMENTS

| | | | | |
|---|---|---|---|---|
| CH | 679071 | A5 * | 12/1991 | F26B 21/00 |
| EP | 2752145 | A2 * | 7/2014 | |
| JP | 2000093383 | A * | 4/2000 | A47L 23/20 |

*Primary Examiner* — Steve M Gravini

(74) *Attorney, Agent, or Firm* — Fay Sharpe LLP

(57) ABSTRACT

A transportable or hand carriable forced air dryer for boots, gloves and facepieces such as gas masks and other headpieces with attached drinking tubes. A pair of manifolds having spaced parallel tubes extend in opposite directions from a blower housing/plenum structure. Each manifold has plural spaced upstanding air discharge tubes. Each air discharge tube has attached thereto a form expander in looped form extending in spaced parallel arrangement and terminating beyond the air discharge to prevent air blockage by the article to be dried. One manifold is permanently connected and the other is quick connected and quick disconnected, without tools for field reassembly. For transport, the released manifold is inverted and nested on the permanently connected manifold for compact installation in a tote bag. The air discharge tubes are provided with a nipple sized and threaded to receive thereon a standard military canteen cap having a reduced size nipple thereon for connection to a drinking tube of a gas mask disposed for drying on an adjacent air discharge tube.

13 Claims, 15 Drawing Sheets

(56) References Cited

U.S. PATENT DOCUMENTS

2005/0204579 A1* 9/2005 Rosseau et al. ..... 34/104
2011/0041354 A1* 2/2011 Williams ..... 34/239
2012/0186098 A1* 7/2012 Williams ..... 34/240
2013/0086811 A1* 4/2013 Williams ..... 34/104
2014/0338212 A1* 11/2014 Williams ..... 34/104

* cited by examiner

TRANSPORTABLE FORCED AIR DRYER

BACKGROUND

The present disclosure relates to electrically operated forced air dryers of the type which are transportable or hand carriable and intended for use in remote locations for drying gloves, boots and facepieces and particularly, gas masks of the type utilized by military personnel. In military usage, particularly for training exercises, it is necessary to dry such articles immediately after usage in order to prevent growth of bacteria and mold within the articles. Heretofore, it has been necessary to transport the articles to be dried to a facility having drying racks. However, rack type dryers for boots, gloves and gas masks due to their size and weight are not practical for field use. Thus, it has been desired to provide a way of drying articles at remote locations and particularly for military field exercises where typically a portable generator set is available for providing electrical power. Thus, it has been desired to provide an easy to carry dryer for boots, gloves, and facepieces, such as gas masks and other headpieces, which may be readily transported by hand carrying in order to enable on site drying to prevent bacterial growth and formation of mold within the articles. It has further been desired to provide a lightweight portable hand carriable dryer for boots, gloves, and facepieces which can be easily hand carried in a container or bag and readily assembled on site without the need of any tools and powered by a portable generator set.

SUMMARY

A transportable, e.g. hand carried, forced air dryer which is electrically operated and suitable for operation from a portable generator set which may be easily transported in a container or tote bag and assembled quickly on site without the need for any tools. The dryer of the present disclosure employs a blower housing containing a blower with an attached structure defining a plenum chamber having a heater therein provided with discharge outlets on opposite sides thereof. On one side of the plenum structure, a first manifold comprising a pair of parallel tubes each attached at one end to a mounting plate is secured permanently over the discharge outlets by fasteners. The tubes have an end support plate permanently attached to the opposite ends thereof. Each of the pair of parallel tubes has a plurality of spaced air discharge tubes attached thereto and communicating interiorly therewith and extending upwardly from the manifold tubes for discharging air therefrom. Each of the air discharge tubes as provided attached thereto a form expanding member which extends upwardly and in spaced generally parallel arrangement and terminating beyond the end of the air discharge tube for preventing articles to be dried from blocking discharge from the discharge interior of the article.

A second manifold comprising a pair of generally spaced parallel manifold tubes has an attachment plate permanently secured to one end of the manifold tubes; and, the attachment plate is configured for quick connect to and quick disconnect from the side of the plenum structure opposite the permanently attached first manifold. The second manifold tubes are provided with a second end plate permanently attached to the end of the parallel tubes distal the plenum. A second end support plate has stepped slots engaging lugs provided on the ends of the second end plate for quick connect and quick disconnect. Each of the parallel tubes has a plurality of spaced air discharge tubes attached thereto and communicating interiorly therewith and oriented for vertically upward air discharge. Each of the discharge air tubes has a form expanding member provided attached thereto extending upwardly and spaced generally parallel thereto and terminating beyond the upper end air discharge tube for preventing the article to be dried from blocking air discharged from the discharge tube to the interior of the article to be dried.

In one version, the quick connect and quick disconnect second manifold has stepped slots in the end plate for engaging a pair of lugs provided on one side of the plenum structure. In another version, quick connect and disconnect second manifold mounting plate has a hooked flange along one edge which engages an upwardly extending edge of the side of the plenum structure for quick assembly thereon.

The upstanding air discharge tubes are sized to receive thereon a nipple configured for receiving thereon a standard NATO military canteen cap with a drinking tube nipple. When a facepiece, such as a gas mask with a drinking tube attached, is placed over one of the air discharge tubes for drying, a nipple is provided on the adjacent discharge tube and a canteen cap is placed over the nipple and the drinking tube connected to the nipple on the canteen cap for forced air drying of the drinking tube.

For transportability, the dryer of the present disclosure has the quick connect and disconnect manifold removed, inverted and stacked in superposed nested arrangement on the permanently attached manifold with the form expanding members and air discharge tubes of the two manifolds interdigitated in compact arrangement. This enables the nested blower housing and manifolds to be assembled into compact container or tote bag along with the power cord, the disconnected end support plate, air discharge tube nipples and lengths of flexible tubing to provide a dryer kit which can be readily removed from the container and quickly reassembled for operation in the field without the need for tools.

DETAILED DESCRIPTION

Figure 1:
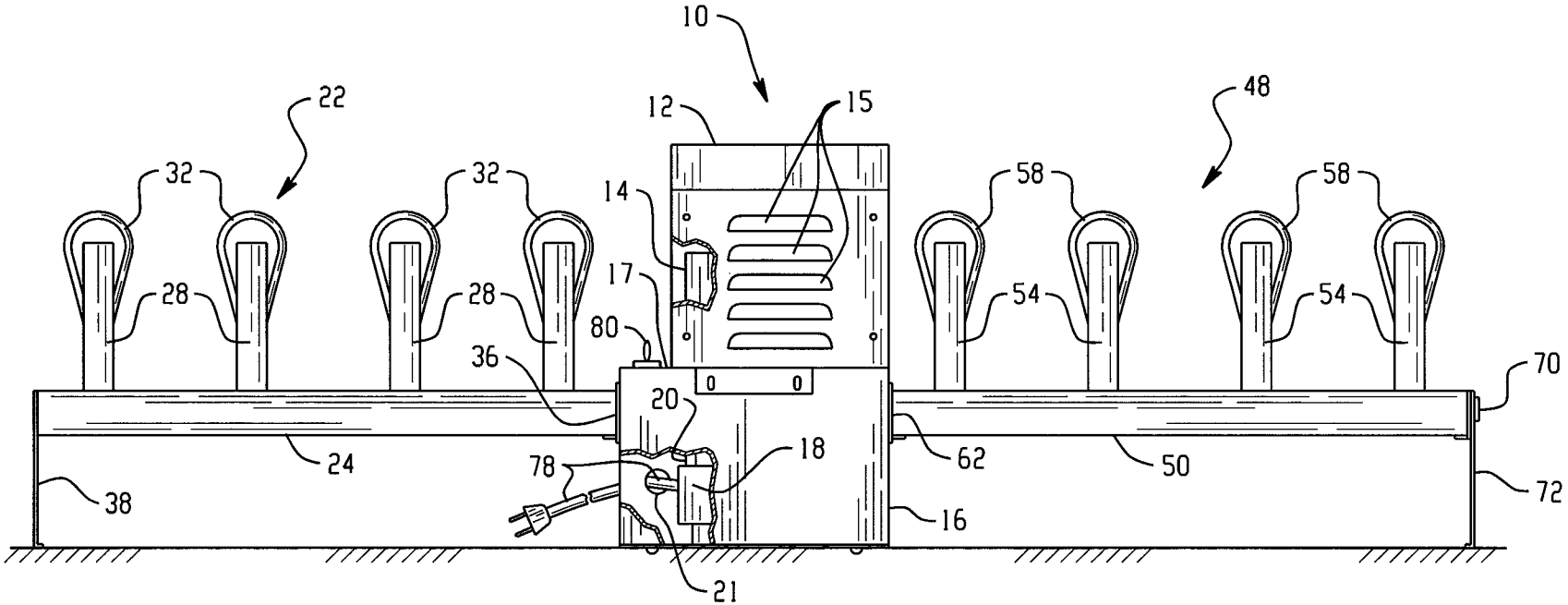
FIG. 1 is a front view of the assembled dryer of the present disclosure.
Figure 2:
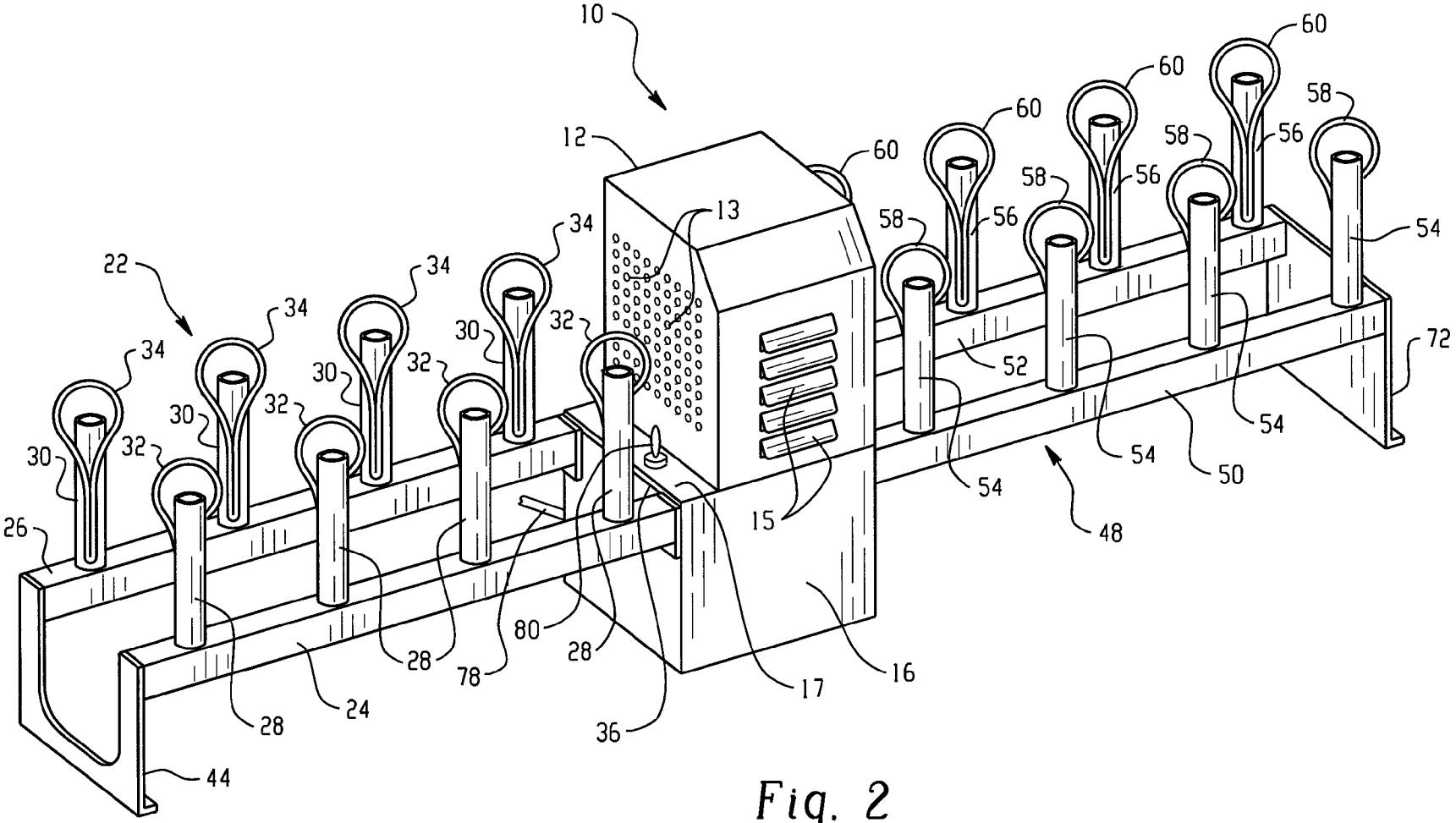
FIG. 2 is a perspective view of the assembled dryer of FIG. 1.

Referring to FIGS. 1 and 2, a dryer according to the present disclosure is indicated generally at 10 and includes a blower housing 12 having therein blower 14; and, the blower housing 12 is attached to a plenum structure 16 which has therein a heater 18 with electrical leads 20 which are connected as will hereinafter be described. The blower housing 12 is offset from center on the plenum structure 16 to provide a shelf or ledge 17 on one side of the structure 16. The blower housing 12 has air inlet ports 13, which may include a filter (not shown). Additional louvers 15 are provided in blower housing 12.

Figure 8:
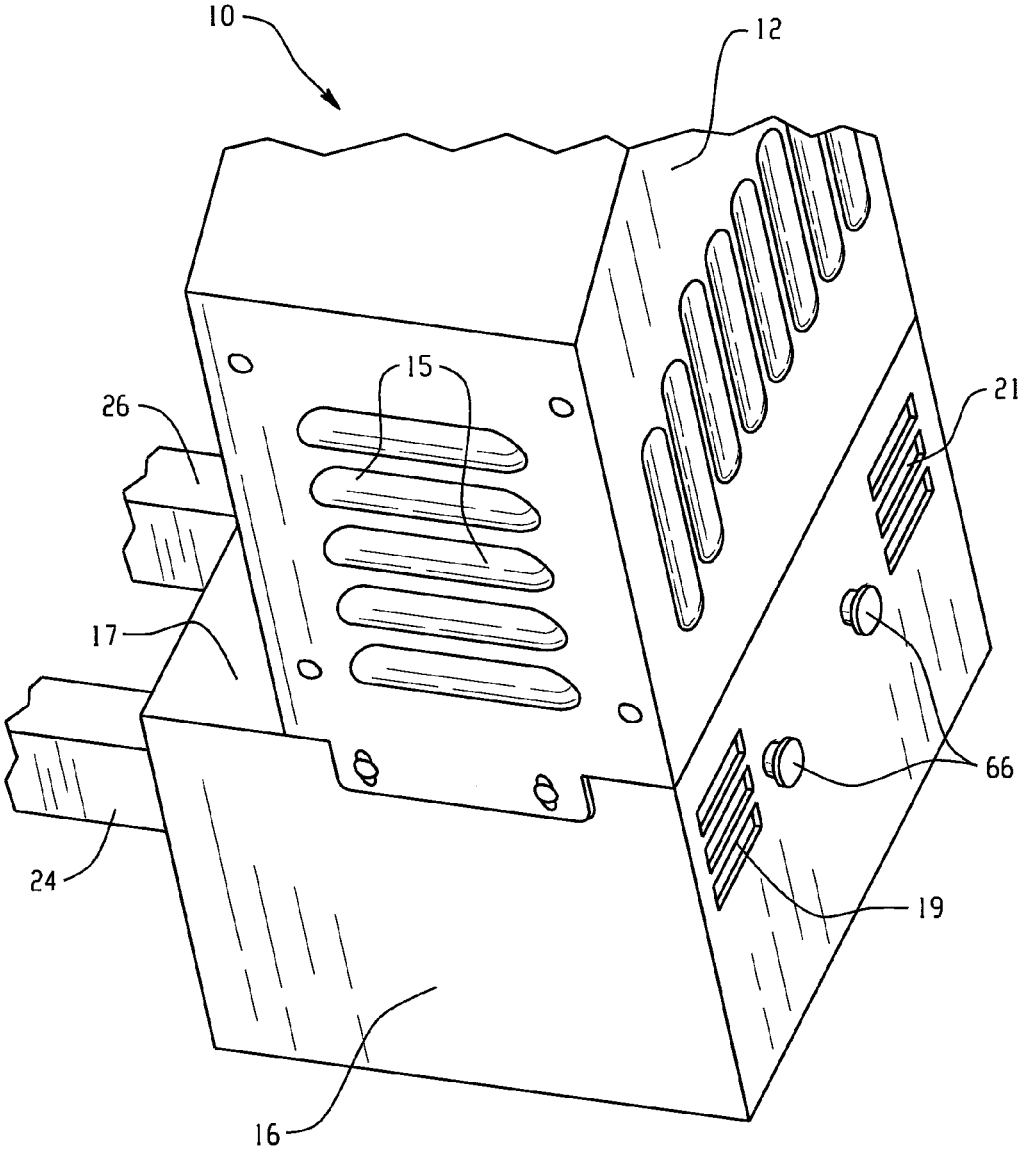
FIG. 8 is a perspective view of the lower housing and plenum structure showing the quick connect and disconnect lugs for the right hand manifold.

Referring to FIG. 8, the plenum structure 16 has a pair of spaced air discharge ports 15, 21 provided on one side thereof; and, a similar set of unshown ports is provided on the side of the plenum structure opposite the side illustrated in FIG. 8.

Figure 4:
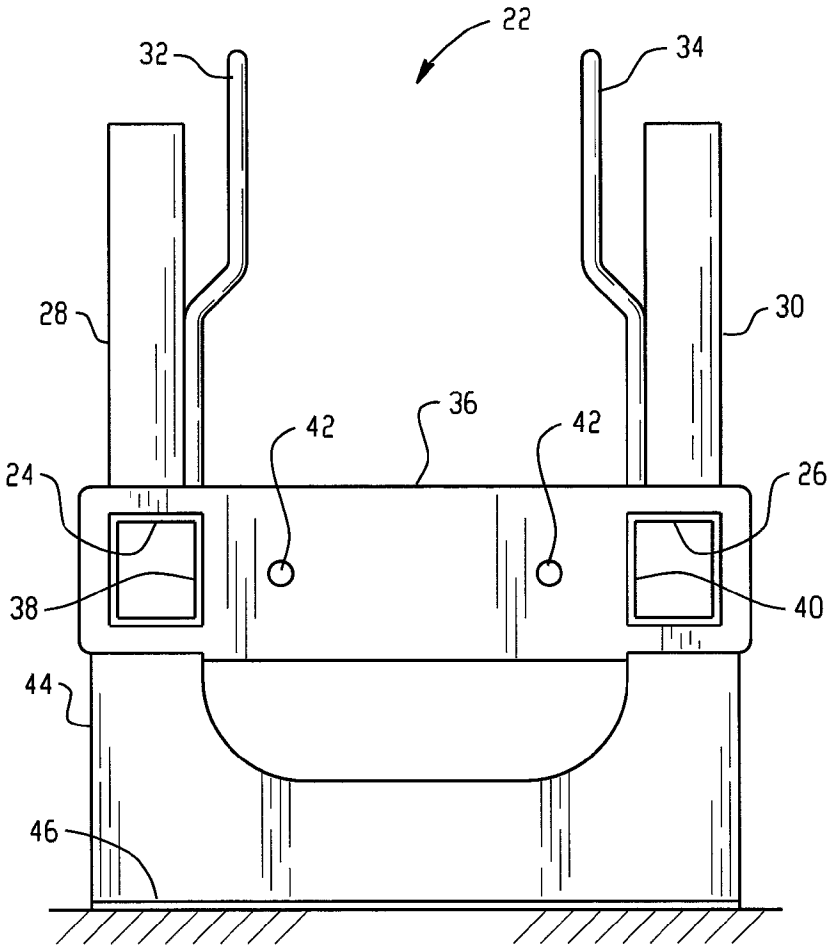
FIG. 4 is an inboard end view of the manifold of FIG. 3.
Figure 3:
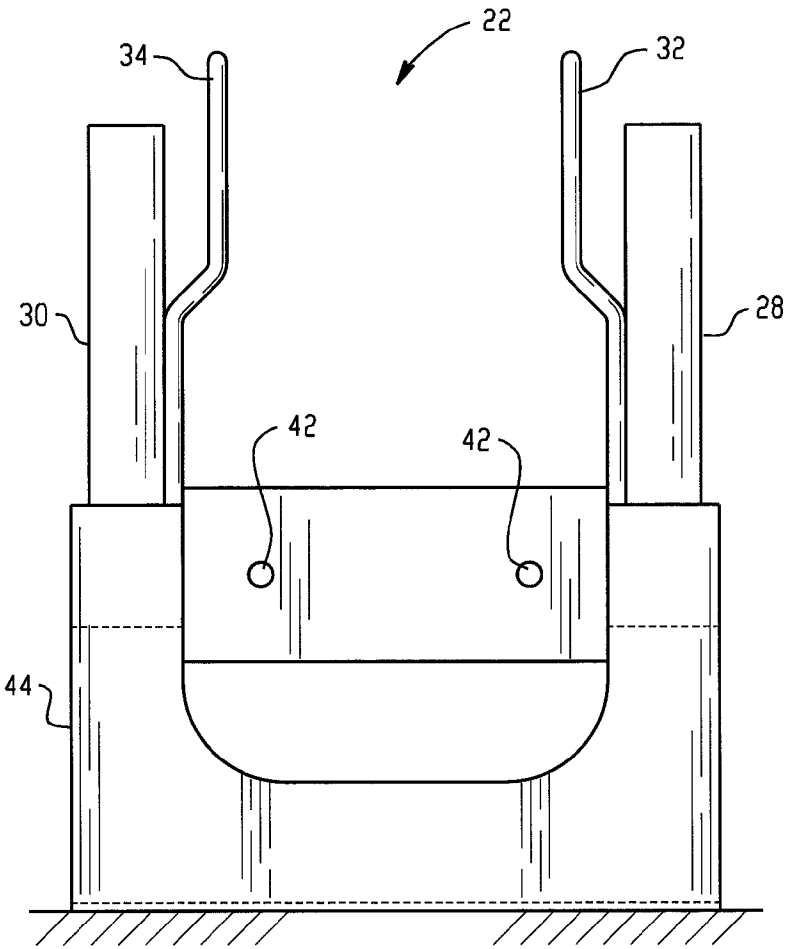
FIG. 3 is an outboard end view of the left hand or permanently attached manifold of the dryer of FIG. 1.

Referring to FIGS. 1-4, a first or left hand manifold assembly is indicated generally at 22 and has a pair of manifold tubes 24, 26 which have a mounting plate 36 formed, with correspondingly spaced apertures 38, 40 therein, attached to the inboard ends of tubes 24, 26 such that the ends of the tubes 24, 26 are received in the apertures 38, 40 respectively and the ends of tubes 24, 26 are open. In the present practice, the manifold tubes are attached to the mounting plate 36 by suitable expedient such as weldment. Mounting plate 36 has another set of spaced apertures 42 provided therein as shown in FIGS. 3 and 4 which apertures are intended to receive fasteners therethrough such as, for example, threaded fasteners in threaded engagement with internally threaded fasteners (not shown) provided on the side wall of the plenum structure 16. Such internally threaded fasteners may comprise clinch nuts or weld nuts attached to the inner surface of the manifold plenum structure 16 in a manner well known in the art. The ends of the manifold tubes 24, 26 distal the mounting plate 36 have an end support plate 44 permanently attached thereto as, for example, by weldment. The end support plate may have a flange 46 formed on the lower edge thereof.

Referring to FIGS. 1-4, the manifold tubes 24, 26 for the manifold assembly 22 have provided on the upper surface thereof a plurality of spaced air discharge tubes ascending upwardly therefrom denoted, respectively, 28, 30 in generally spaced parallel upstanding arrangement. The lower end of each of the air discharge tubes 28, 30 is attached over apertures (not shown) on the upper surface of each of the tubes 24, 26 such that the interior of the air discharge tubes 28, 30 communicates with the interior of the respective manifold tubes 24, 26. In the present practice, the tubes 28, 30 are attached to the upper surface of the manifold by a suitable expedient, such as, for example, weldment.

With continued reference to FIGS. 1-4, the manifold assembly 22 has a form expanding member attached to each of the air discharge tubes 28, 30 denoted respectively 32, 34 in the drawings. In the present practice, the form expanding members 32, 34 comprise loops with their ends attached to the lower portion of the respective discharge tube 28, 30; and, the looped portion extends upwardly so as to terminate a significant distance above the end of the respective air discharge tube. This arrangement maintains the article to be dried, whether it is boots, gloves or facepieces, spaced above the upper ends of the air discharge tubes 28, 30 so as to prevent blockage of air discharge from the end of the tubes from the drying article disposed thereover. In the present practice, it has been found satisfactory to form the manifold assembly 22 components of aluminum material. In the present practice the form expanding members 32, 34 are formed of aluminum wire having a diameter of about 6 mm; however, other sizes may be employed. The components of the manifold 22 may be alternatively of other suitable materials, as, for example, stainless steel or suitable structural plastic. In the present practice in the illustrated version, the combined blower housing 12 and plenum structure have a width of about 22.9 cm, a depth of about 23.8 cm and a height of about 34.6 cm. However, other sizes and configurations may be employed. In the present practice in the illustrated version, manifold tubes 24, 26 have a square cross-section of about 38 mm on a side and a length of about 495 mm; and, the air discharge tubes have an outside diameter of about 25 mm. However, other dimensions may be employed for the tubes.

In the present practice, the air discharge tubes 28, 30 are provided with a nipple, as will be hereinafter described, for receiving thereon a standard NATO military canteen cap thereon for attachment of a drinking tube.

Figure 5:
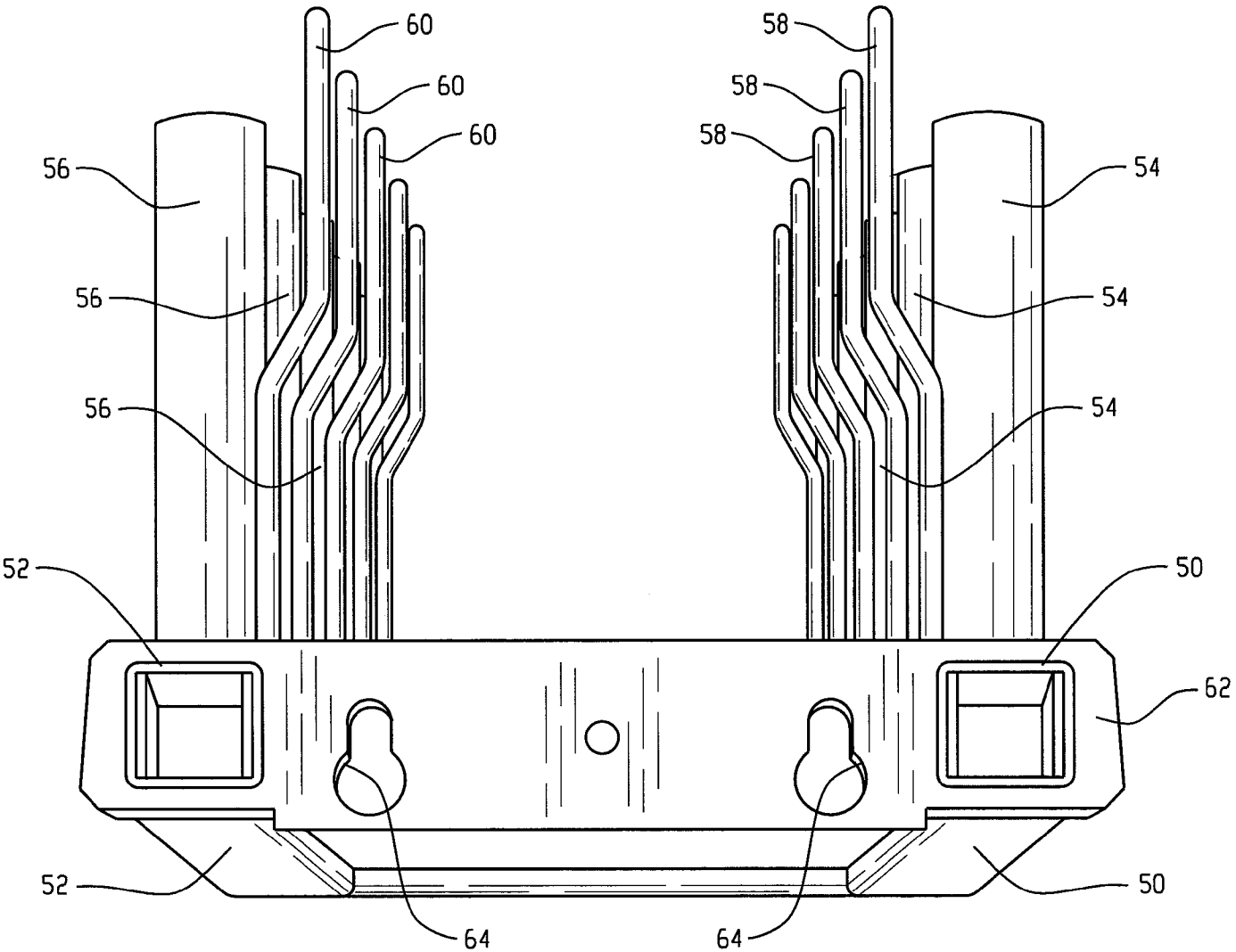
FIG. 5 is an inboard end view of the right hand or quick connect and disconnect manifold of the dryer of FIG. 1.

Referring to FIGS. 1, 2 and 5-8, the dryer of the present disclosure has a second or right hand manifold indicated generally at 48 in the drawings disposed in oppositely directed arrangement on the plenum structure from the manifold 22. However, the right hand manifold 48 is designed for quick connect and quick disconnect from the plenum structure 16 without the aid of any tools. The manifold 48 has a pair of spaced generally parallel manifold tubes 50, 52, each having the inboard end thereof attached to a mounting plate 62 through aperture 50, 52 in plate 62 such that the ends of tubes 50, 52 are open through the mounting plate 62 as shown in FIG. 5. The mounting plate 62 also has formed therein, between the tubes 52, 50, a pair of spaced stepped slots 64 which serve to provide the quick connect and quick disconnect of the mounting plate 62 of the manifold 48 to the plenum structure 16.

Referring to FIG. 8, a pair of spaced lugs are provided on the side wall of the plenum structure 16, intermediate the air discharge ports 19, 21 as denoted by reference numeral 66. The manifold 48 is, thus, connected to the plenum structure 16 by engaging the slots 64 over the the lugs 66 such that the narrower portion of the stepped slots 64 engage the reduced diameter portion of the lugs 66 and retains the manifold tubes in place over the air discharge ports 19, 21.

Manifold 48 also has spaced along the tubes 50, 52 a plurality of upwardly extending air discharge tubes 54, 56, respectively. The manifold 48 also has form expanding members 58, 60, respectively, attached to each of the air discharge tubes and arranged in a looped spaced parallel manner similar to the members 30, 32 of the manifold 22.

Figure 6:
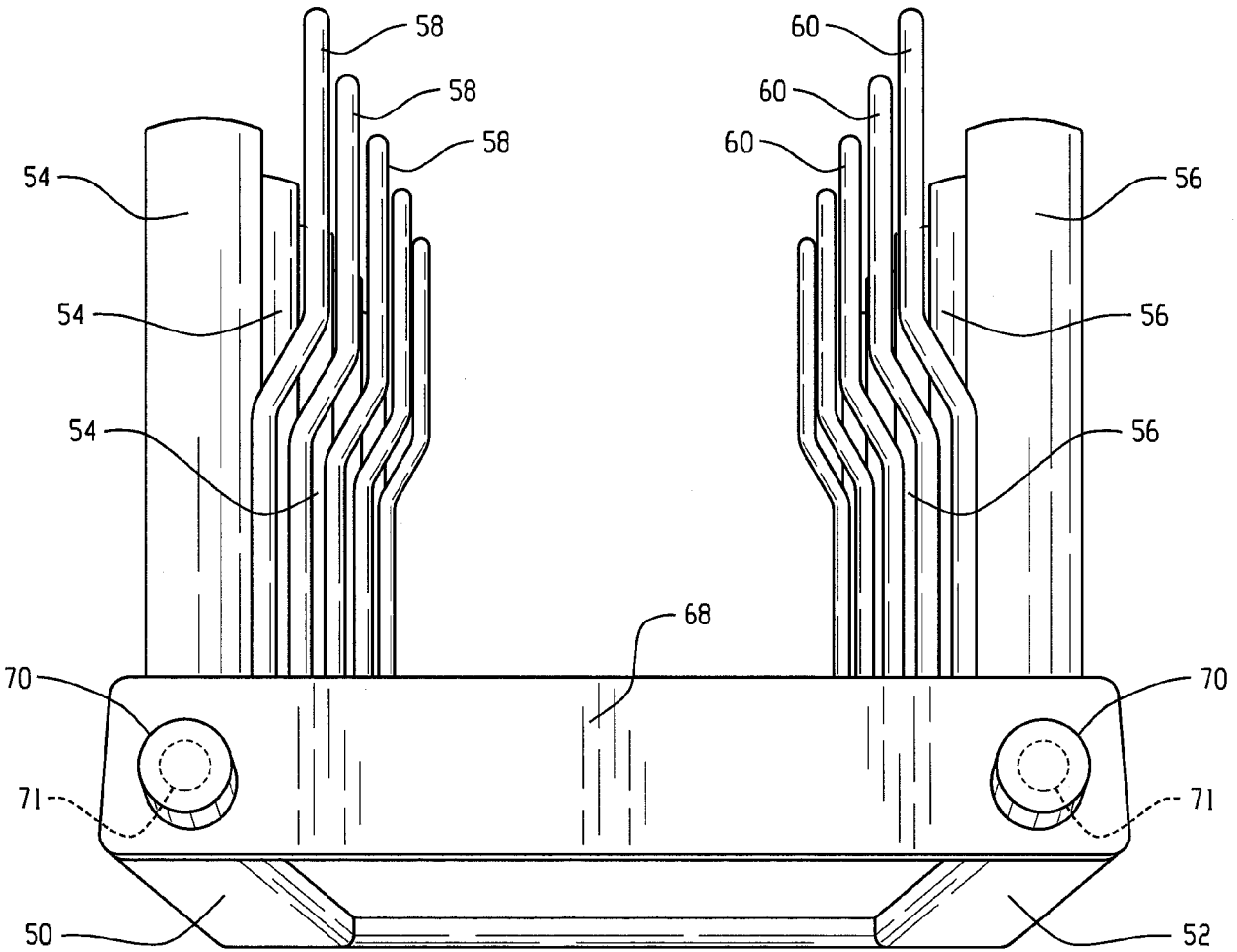
FIG. 6 is an outboard end view of the connect and disconnect manifold of FIG. 5.

The manifold 48 has an end plate 68 attached, as, for example, by weldment to the ends of the tubes 50, 52 as shown in FIG. 6. Plate 68 has provided thereon a pair of spaced attachment lugs 70 which have reduced diameter portion, shown in dashed line in FIG. 6, attached to the end plate 68.

Figure 7:
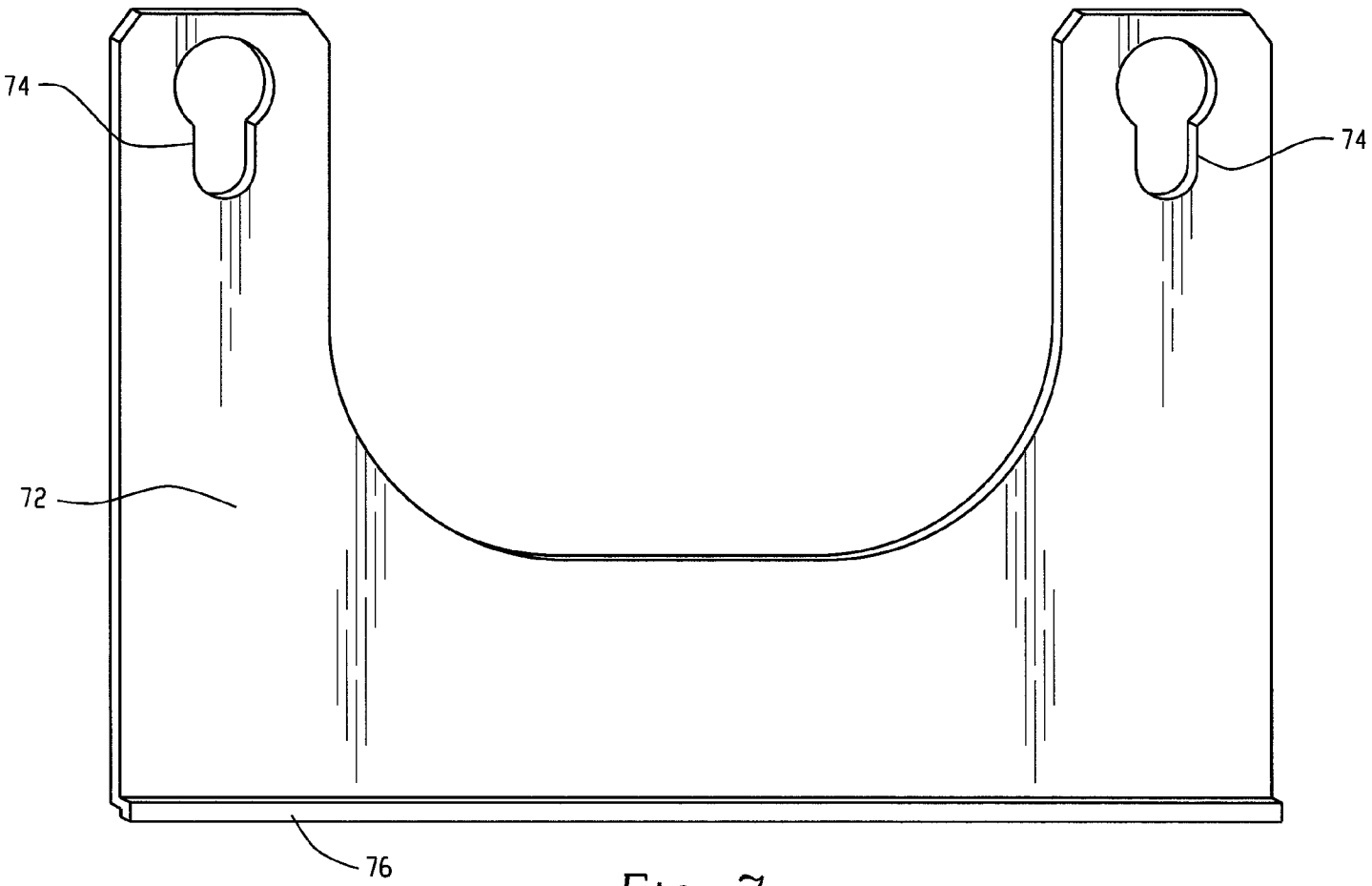
FIG. 7 is a plan view of the quick connect and disconnect end support plate for the manifold of FIG. 5.

Referring to FIGS. 1, 2 and 7, and end support plate 72 for manifold 48 has provided therein spaced stepped slots as shown in FIG. 7 which are configured to slidingly engage the lugs 70 on manifold end plate 68 and quick connect and disconnect arrangement for supporting the ends of manifold tubes 50, 52. In the present practice, the components of the manifold 48 are formed of the same materials and configuration as those of the manifold 22; and, the air discharge tubes 54, 56 and support forms 58 are similarly configured.

Figure 9:
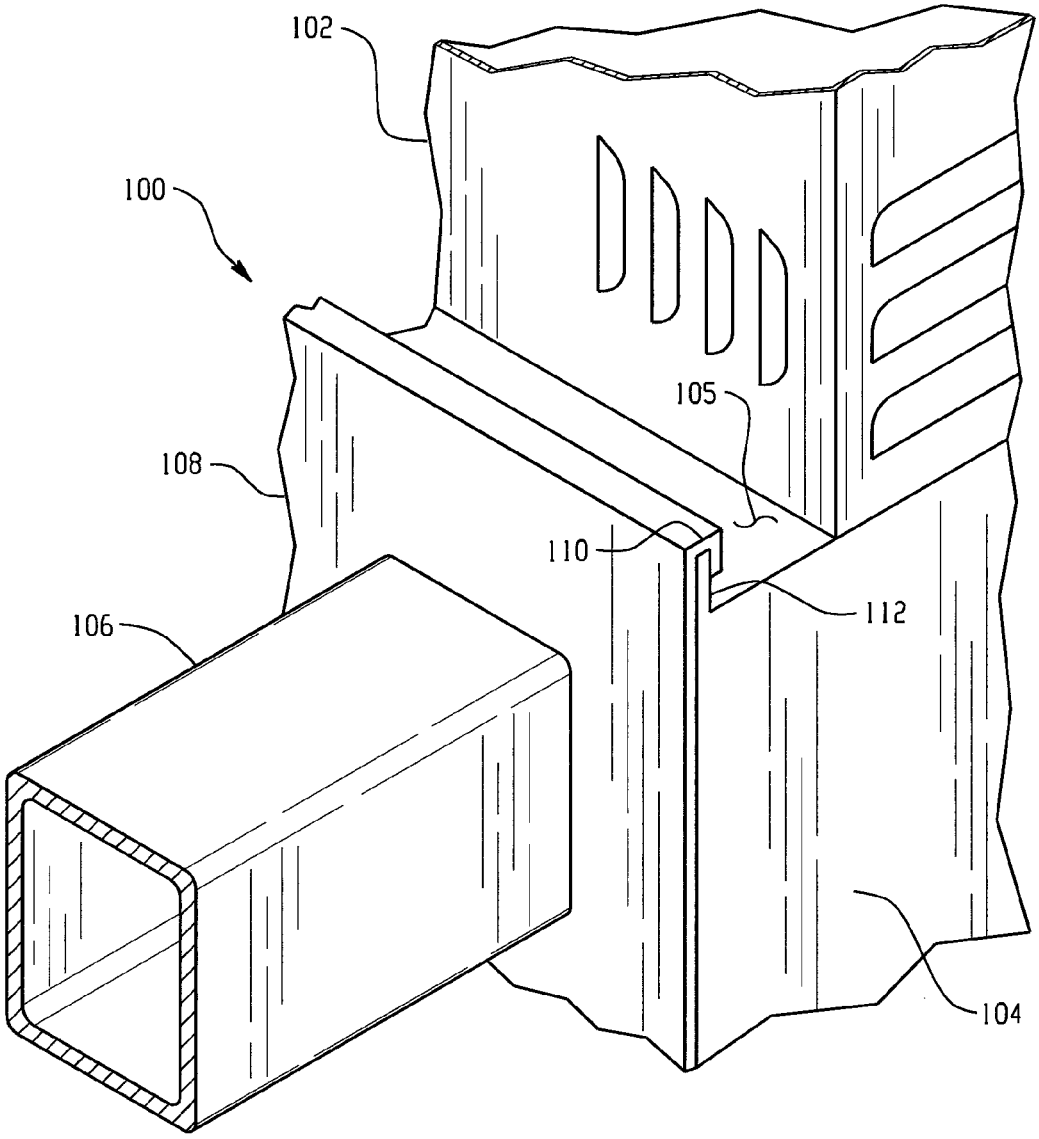
FIG. 9 is a perspective view showing a portion of the dryer of the present disclosure having an alternate version of the arrangement for the quick connect and disconnect of the right hand manifold to the plenum.

Referring to FIG. 9, an alternate version 100 of the quick connect and quick disconnect of the right hand manifold to the plenum structure is shown, wherein a blower housing 102 is attached to a plenum structure 104 which has a side 112 thereof extending upwardly from the upper surface 105 of the plenum structure. A manifold mounting plate 108 is shown with a portion of one manifold tube 106 attached thereto and has the upper edge thereof formed in a hooked configuration as denoted by reference numeral 110. The hooked portion of the mounting plate 108 is registered over the upwardly extending edge 112 of the side of the plenum structure to permit quick connect and quick disconnect of the manifold mounting plate 108 therefrom. It will be understood that, if desired, the arrangement of the quick connect and disconnect of the manifold mounting plate 108 shown in FIG. 9 may also be employed for connect and disconnect of an end supporting plate for the manifold; however, such connection has been omitted for brevity of description.

Figure 10:
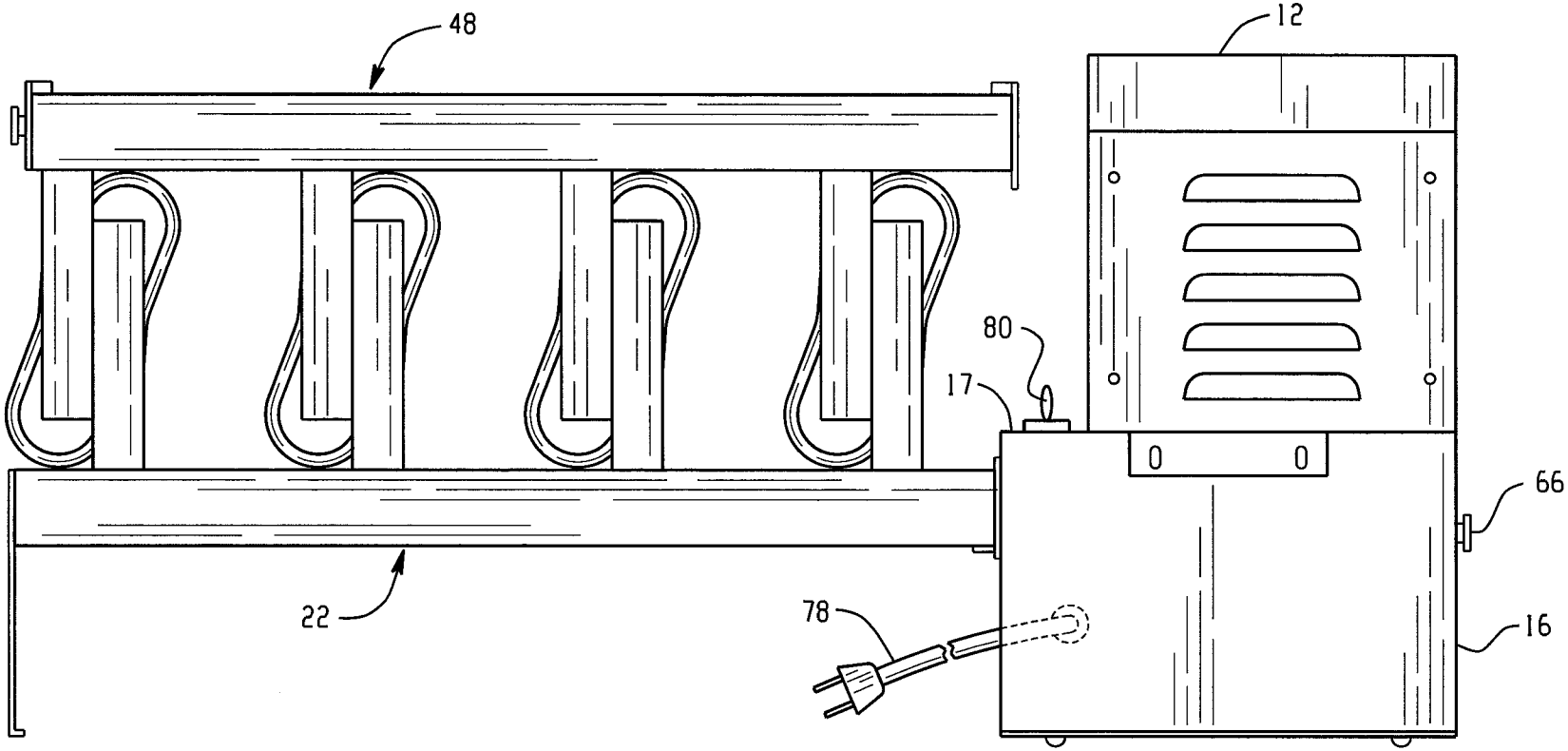
FIG. 10 is a front view of the disassembled dryer with the manifolds nested for positioning in a container.
Figure 11:
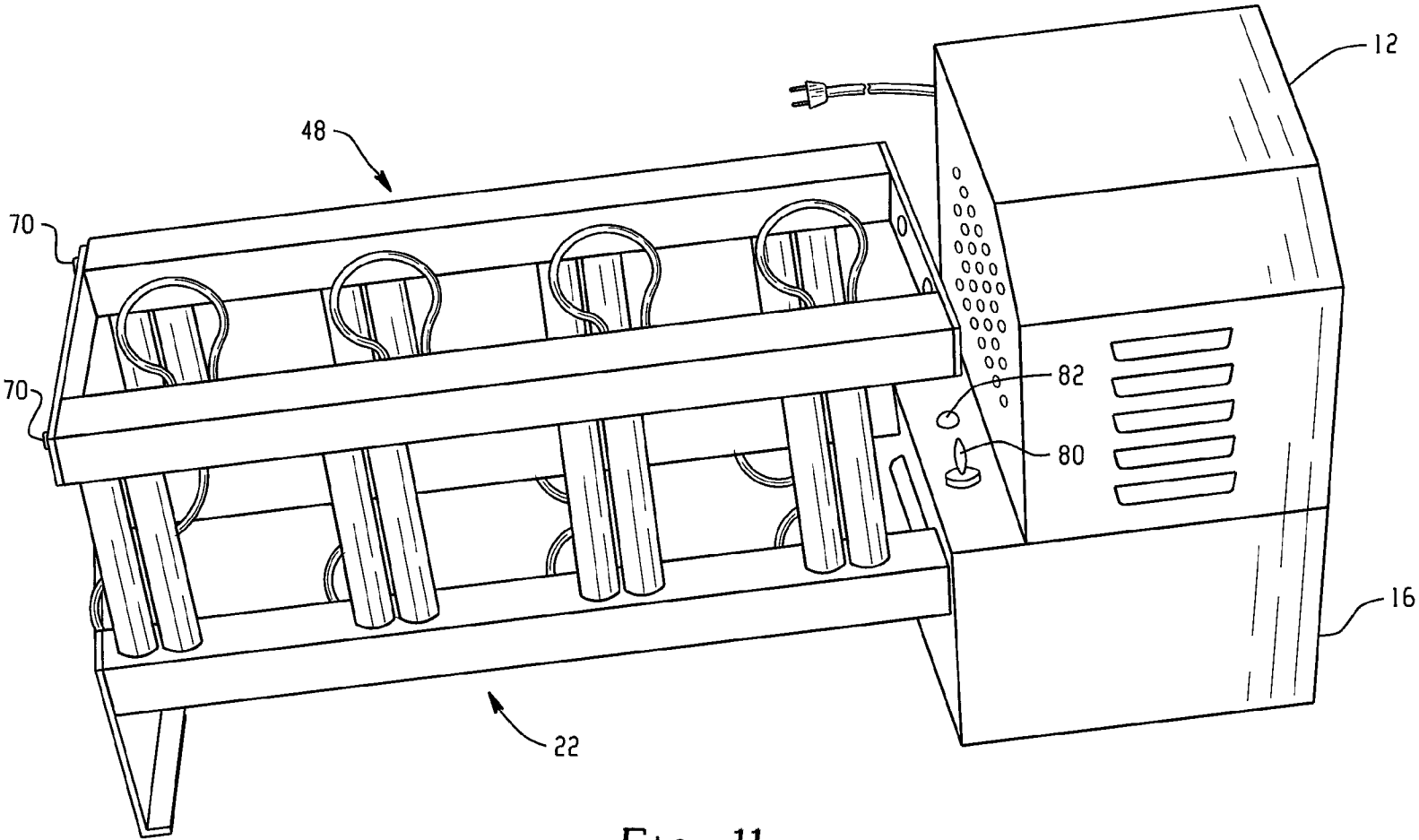
FIG. 11 is a perspective view of the arrangement of FIG. 10.

As shown in FIGS. 1, 10 and 11, the plenum structure 16 is provided with electrical leads through cord 78 which may be wired through the back of the plenum structure 16, through aperture 21, shown in FIG. 4 in solid outline and in dashed line in FIG. 10. The power cord is connected internally to switch 80 provided on the plenum shelf 17 of the plenum structure 16. The switch is connected to the heater 18 and through power cord 20 to the blower and wired for selectively energizing the blower 14 and both the blower 14 the heater 18. In the present practice, switch 80 is a double throw center position OFF switch with movement in one direction from center providing blower ON; and, movement of switch 80 in an opposite direction from center providing both blower ON and heater ON. Switch 80 may be a toggle switch as shown. Thus, the dryer of the present disclosure may provide ambient forced air or forced heated air to the manifolds 22, 48. If desired, a heater ON lamp 82 may be provided as shown in FIG. 11. If desired, a temperature limiting sensor switch (unshown) may be incorporated in the plenum to cut off power in the event the plenum temperature exceeds a predetermined value.

Figure 12:
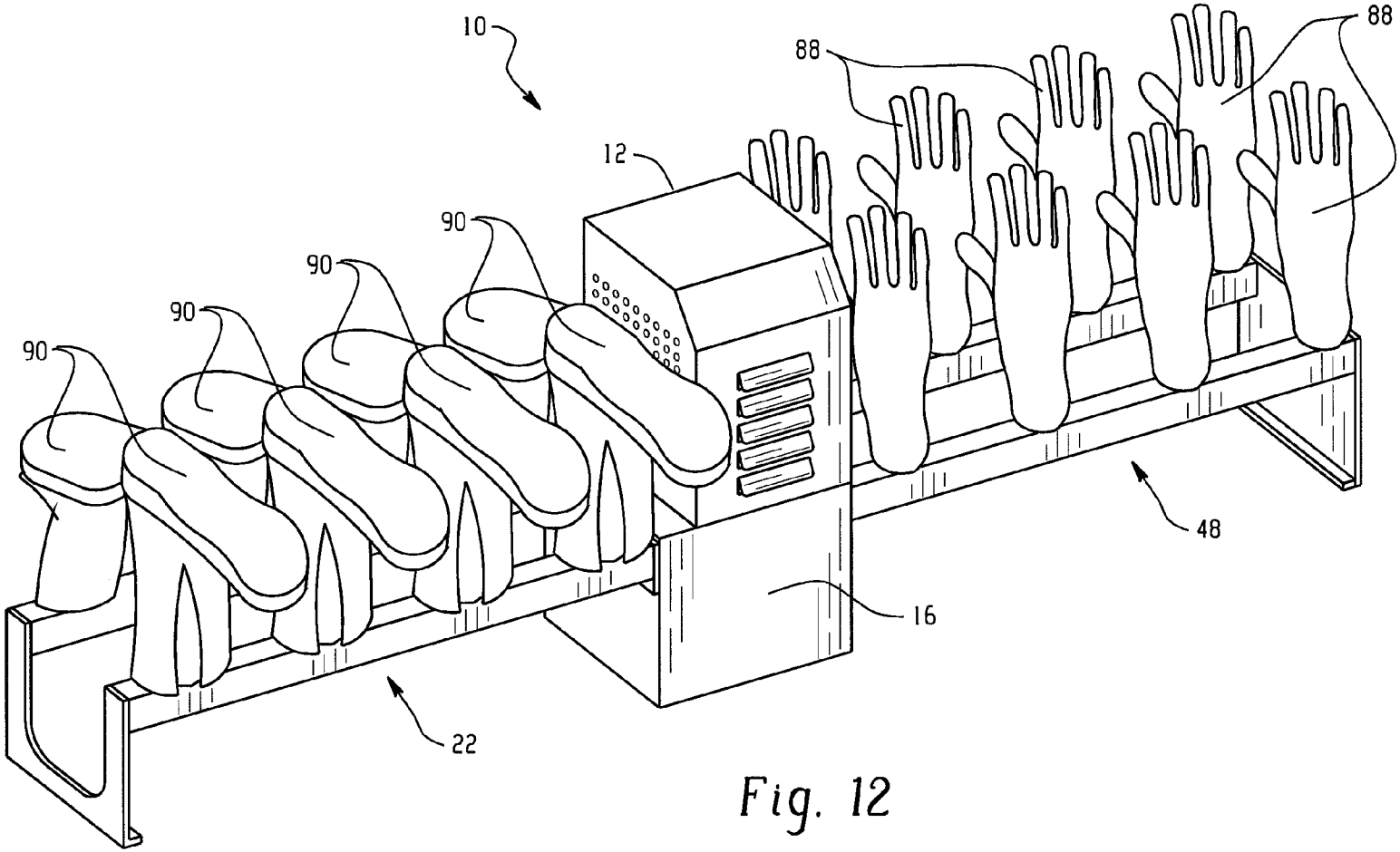
FIG. 12 is a perspective view of the dryer of the present disclosure with boots and gloves disposed thereon for drying.
Figure 13:
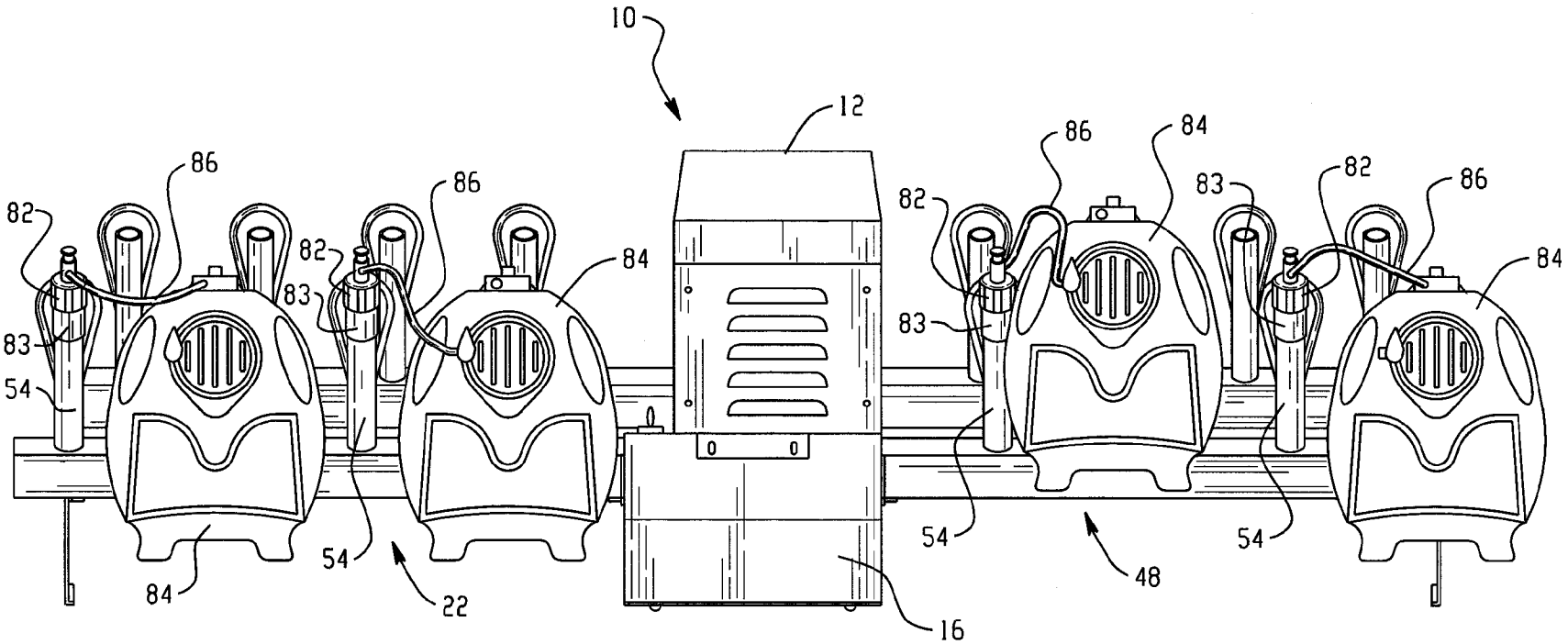
FIG. 13 is a perspective view of the dryer of the present invention with gas masks having drinking tubes disposed thereon with the drinking tubes connected to canteen caps disposed on adjacent air discharge tubes.

Referring to FIGS. 12 and 13, the assembled dryer 10 is shown in FIG. 12 as having boots 90 mounted on the air discharge tubes of manifold 22 and gloves 83 mounted on the air discharge tubes of manifold 48 and positioned for being dried upon energization of the blower.

Referring to FIG. 13, the dryer 10 is shown as having facepieces in the form of gas masks 84 with drinking tubes 86 disposed on alternate air discharge tubes.

Figure 16:
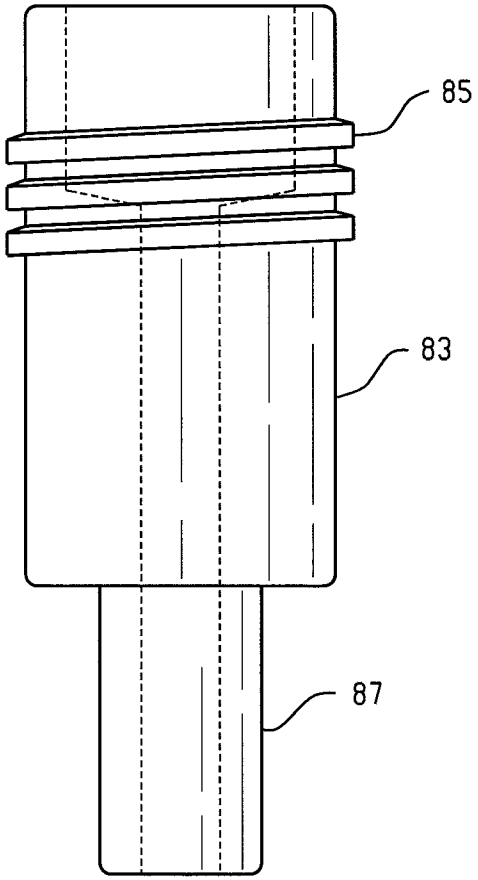
FIG. 16 is a view similar to FIG. 15, of another version of a nipple for the air discharge tubes.
Figure 15:
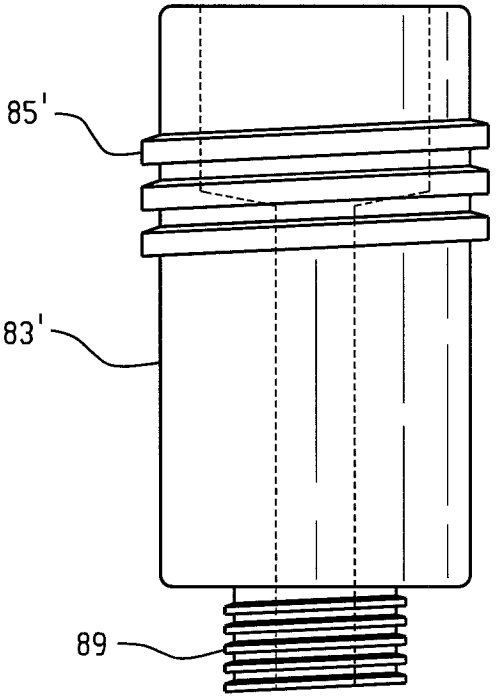
FIG. 15 is an elevation view of a nipple for the air discharge tubes for receiving a canteen cap.

Referring to FIGS. 13, 15 and 16, the alternate air tubes adjacent the air discharge tubes with facepieces 84 thereon have a nipple 83 provided thereon which is provided with external threads 85 thereon which threads are configured for receiving thereon the standard NATO military canteen cap 82. In one version of the nipple 83 shown in FIG. 16, a reduced diameter portion 87 is formed on the nipple 83 and is sized to interfit the inner diameter of the air discharge tubes 54.

Referring to FIG. 15, it is indicated at 83' and has external threads 85' configured for engaging the internal threads in a standard NATO military canteen cap. The nipple 83' has reduced diameter external threads 89 provided on the end thereof opposite the external threads 85' for engaging internal threads (unshown) in the upper end of the air discharge tubes 54. The version of the nipple 83 shown in FIG. 16 is employed with the dryer of the present disclosure where the dryer is intended to be used for drying any of gloves, boots or or facepieces or other headpieces. Nipple 83 has the lower portion 87 sized for slip fitting into the inner diameter of the air discharge tubes 54.

Where the dryer of the present disclosure is intended to be dedicated for facepiece drying, the nipple 83' of FIG. 15 may be permanently installed with the threads 89 into the end of the air discharge tubes.

Standard NATO military canteen caps 82 are disposed over the nipples on the air discharge tubes adjacent each gas mask; and, the drinking tubes 86 connected to the nipple provided on the canteen cap 82.

Figure 14:
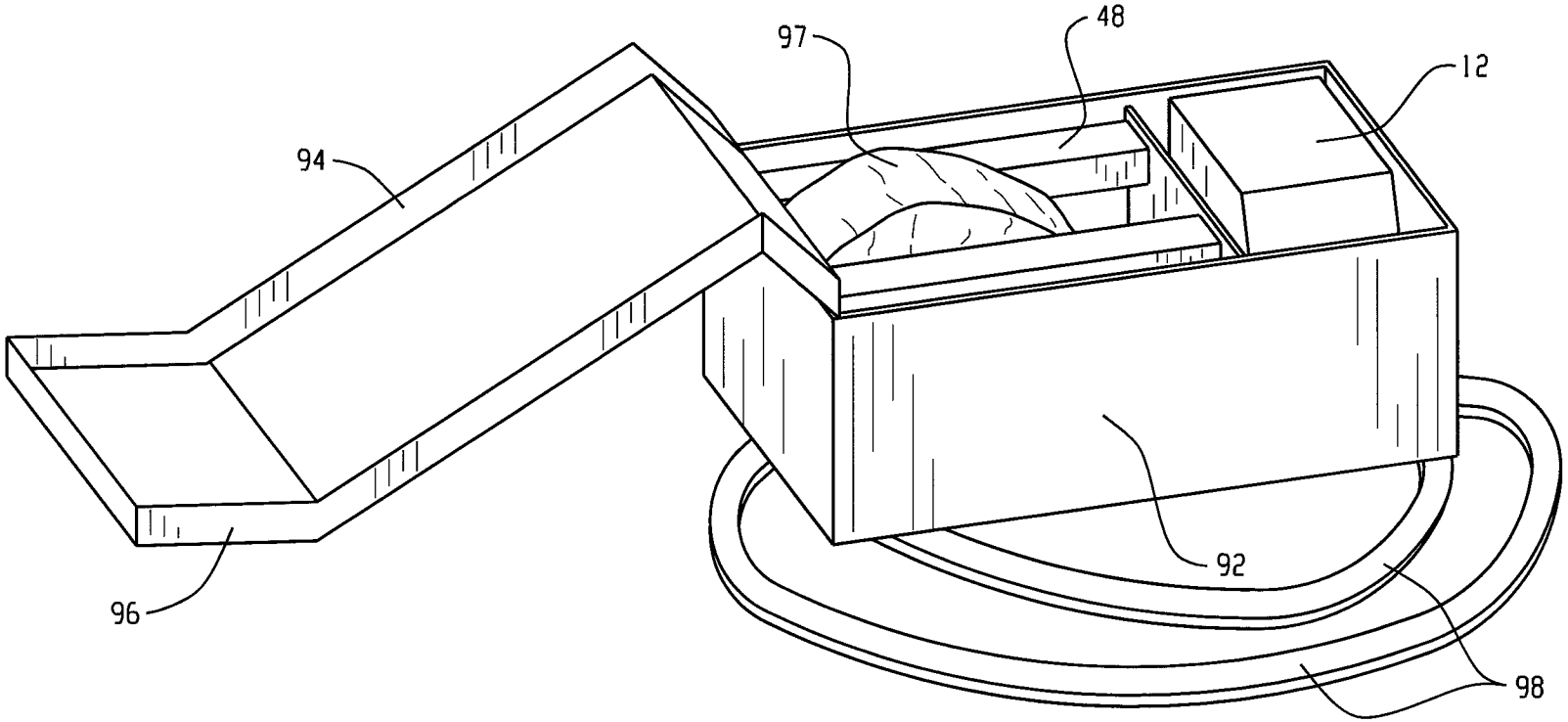
FIG. 14 is a perspective view of the disassembled dryer of the present disclosure disposed in a tote bag for transportability.

Referring to FIG. 14, the disassembled dryer is shown installed as a kit in a tote bag or carrier 92 with the manifold 48 nested on manifold 22 as shown in FIGS. 10 and 11. The end support plate 72 and nipples 83, 83' are in a separate pouch or bag 97.

Figure 17:
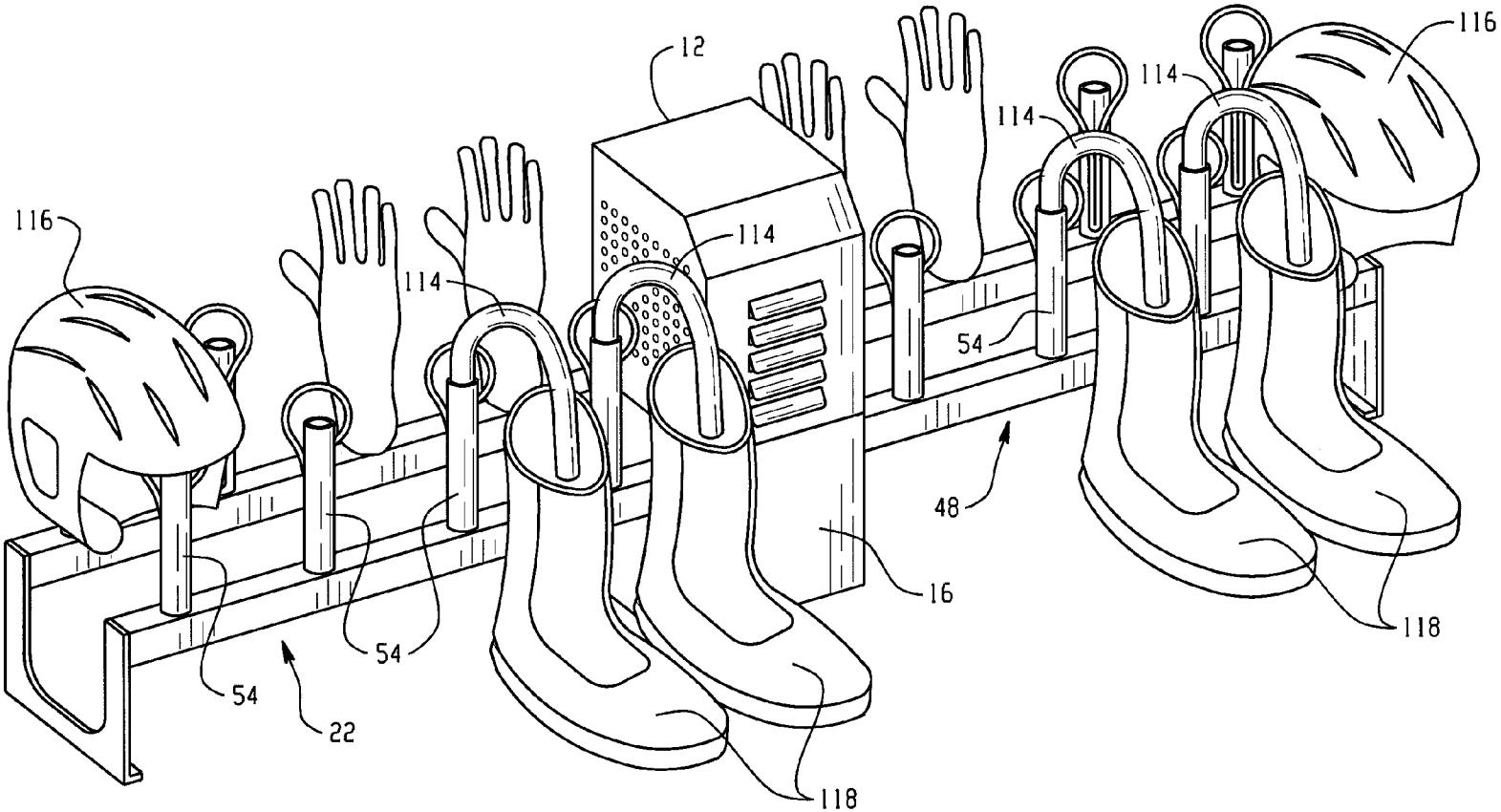
FIG. 17 is a perspective view of the dryer of the present disclosure utilizing the flexible tube for off manifold drying.

Referring to FIG. 17, if desired, lengths of flexible tubing 114, such as commercially available plastic tubing, may be provided in the kit. The tubing 114 is sized for insertion in the ends of air discharge tubes 54 for providing forced air from the dryer air discharge tubes for off-manifold drying, such as boots 118. As shown in FIG. 17, other types of headpieces denoted 116 may be positioned over one or more of the air discharge tubes for drying. The tote bag 92 may have a spacer pad 94 provided on the corner or closure 96 for acting as a stuffer to hold the dryer components in position in the carrier 92 which is provided with carrying straps/handles 98. In the present practice, the illustrated version of the disassembled dryer components and carrier 92 have a combined weight of about 13.2 kilograms and are, thus, easy to carry.

Obviously, modifications and alterations will occur to others upon reading and understanding the preceding detailed description. It is intended that the exemplary versions described herein be construed as including all such modifications and alterations insofar as they come within the scope of the appended claims or the equivalents thereof.

The invention claimed is:

1. A transportable forced air dryer for articles of apparel comprising:

(a) a blower housing including a blower therein;

(b) structure defining a plenum chamber attached to the blower housing and operative to receive in the plenum chamber forced air from the blower and including a first and second set oppositely directed air discharge ports;

(c) a first and second manifold, each including a pair of spaced generally parallel tubes each having an open end and a closed end, wherein the open end of each pair of tubes is attached to a mounting member, wherein the mounting member for the pair of tubes of the first manifold is non-removably attached to the blower plenum with the respective open ends of the pair of tubes communicating with the first set of air discharge ports; and, the mounting member of the second manifold is releasably quick-connected to the blower plenum with the respective open ends of the pair of tubes communicating with the second set of air discharge ports;

(d) a plurality of air discharge tubes disposed on each of the generally parallel tubes and having an end thereof receiving forced air therefrom;

(e) a form expanding member for an article to be dried disposed adjacent each air discharge tube in spaced generally parallel relationship thereto for preventing an article received over the respective air discharge tube from blocking air discharge therefrom; and, (f) a first end support member non-releasably attached to the ends of the pair of tubes of the first manifold distal the mounting member; and, a second end support member releasably quick-connected to the ends of the pair of tubes of the second manifold distal the mounting member, wherein upon quick-disconnect of the second mounting member of the second manifold from the blower plenum, wherein the second manifold is operative to be inverted and nested on the first manifold with the respective discharge tubes and form expanding members of the first and second manifolds closely interdigitated for compactness of packaging in a container.

2. The dryer of claim 1, wherein the blower plenum includes a pair of spaced mounting lugs and the second manifold mounting member includes a pair of slots correspondingly spaced for slidably engaging and disengaging the lugs for effecting quick connect and disconnect of the second manifold.

3. The dryer of claim 1 further comprising a nipple releasably disposed over an end of a discharge tube adjacent a discharge tube having a facepiece received thereon for drying, wherein the nipple is configured to receive a canteen cap thereon for connection to a drinking tube attached to the facepiece for separately discharging air into the drinking tube.

4. The dryer of claim 3, wherein the air discharge fitting on the nipple includes a threaded portion for connection to a canteen cap.

5. The dryer of claim 1, wherein the first and second mounting members comprise a thin plate member having a stiffening flange formed on an edge thereof.

6. The dryer of claim 1, wherein each of the form support members comprises a wire loop attached to each of the respective air discharge tubes.

7. The dryer of claim 1, wherein the mounting plate of the second manifold includes a hooked flange releasably engaging an edge of the plenum structure for effecting the quick connect and disconnect.

8. The dryer of claim 1, wherein the form expanding member extends vertically beyond the air discharge tube.

9. The dryer of claim 1 further comprising a nipple sized and configured for connection to the air discharge tubes and configured for receiving thereon a NATO standard military canteen cap.

10. A kit for a transportable forced air dryer for articles of apparel comprising:

(a) a blower housing with an electrically operated blower therein and a blower plenum with a power cord attached to the plenum with a first air distribution manifold non-releasably attached to one side of the plenum, the first manifold including a pair of spaced generally parallel tubes, each with a plurality of spaced air discharge tubes and form expander for an article to be dried disposed with each discharge tube in spaced in generally parallel relationship thereto and an end support member non-releasably attached to the pair of tubes distal the plenum;

(b) a second air distribution manifold with a pair of spaced generally parallel tubes attached to a mounting plate configured for quick-connect and disconnect to a side of the plenum opposite the first manifold, the second manifold including a plurality of spaced air discharge tubes disposed on the pair of parallel tubes and an article form expander for an article to be dried disposed in spaced generally parallel relationship thereto from each air discharge tube and an end support member configured for connect and disconnect on the second manifold;

(c) wherein the second manifold is nested inverted on the first manifold with the respective discharge tubes and article support form closely interdigitated; and, (d) a container having the blower housing with plenum and nested manifolds, power cord and second support plate received therein, the container sized for closely interfitting over the nested components for hand carrying the dryer to a remote site for assembly and operation.

11. The kit of claim 10, wherein the container comprises a tote bag.

12. The kit of claim 10, further comprising a plurality of nipples for connection to the air discharge tubes and configured for receiving thereon a NATO standard military canteen cap.

13. The kit of claim 10, further comprising a plurality of lengths of flexible tubing sized to interfit the ends of the air discharge tubes.

* * * * *

UNITED STATES PATENT AND TRADEMARK OFFICE

CERTIFICATE OF CORRECTION

PATENT NO. : 8,955,234 B2
APPLICATION NO. : 13/894534
DATED : February 17, 2015
INVENTOR(S) : Gary Williams It is certified that error appears in the above-identified patent and that said Letters Patent is hereby corrected as shown below:

In the Claims

Col. 6, in claim 1, subparagraph (b), line 47, replace "and second set oppositely" with --and second set of oppositely--

Col. 6, in claim 10, subparagraph (b), line 11, replace "in spaced in generally parallel" with --in spaced generally parallel--

Signed and Sealed this
Second Day of June, 2015

Michelle K. Lee

Michelle K. Lee
*Director of the United States Patent and Trademark Office*